US007222658B2

(12) United States Patent
Roehrig et al.

(10) Patent No.: US 7,222,658 B2
(45) Date of Patent: May 29, 2007

(54) DIE CAVITY OF A CASTING DIE FOR CONTINUOUSLY CASTING BILLETS AND BLOOMS

(75) Inventors: Adalbert Roehrig, Thalwil (CH); Franz Kawa, Adliswil (CH)

(73) Assignee: Concast AG, Zurich (CH)

( * ) Notice: Subject to any disclaimer, the term of this patent is extended or adjusted under 35 U.S.C. 154(b) by 0 days.

(21) Appl. No.: 11/426,660

(22) Filed: Jun. 27, 2006

(65) Prior Publication Data

US 2006/0278363 A1 Dec. 14, 2006

Related U.S. Application Data

(63) Continuation of application No. PCT/EP2004/014139, filed on Dec. 11, 2004.

(30) Foreign Application Priority Data

Dec. 27, 2003 (EP) ..... 03029867.3

(51) Int. Cl.
*B22D 11/04* (2006.01)

(52) U.S. Cl. ..... 164/418; 164/459

(58) Field of Classification Search ..... 164/418, 164/459

See application file for complete search history.

(56) References Cited

U.S. PATENT DOCUMENTS 5,360,053 A 11/1994 Adrian et al.

FOREIGN PATENT DOCUMENTS

| | | | |
|---|---|---|---|
| EP | 0875312 | | 11/1998 |
| JP | 53011124 | | 2/1978 |
| JP | 60040647 | | 3/1985 |
| JP | 10-128500 | * | 5/1998 |
| JP | 11151555 | | 6/1999 |
| WO | WO-96/33034 A | | 10/1996 |

OTHER PUBLICATIONS

Ironmaking and Steelmaking, vol. 30, No. 6, pp. 503-510, xp001181788.

* cited by examiner

*Primary Examiner*—Kuang Y. Lin
(74) *Attorney, Agent, or Firm*—Darby & Darby

(57) ABSTRACT

A die cavity of a casting die, such as for continuously casting billets, blooms and blanks. The die cavity has a cross-section with a partially curved peripheral line, whereby, with the cavity walls cooled, provides improved heat exchange between a forming strand shell and the die cavity wall, thus avoiding solidification defects in the strand shell. The degree of curvature 1/R is reduced at least on part of the curved peripheral line of the corner regions from peripheral lines of the same corner regions, that are successive in the casting direction, and at least over part of the length of the die, in the concave corner regions of the die cavity, in order to control the targeted closure of the gap between the strand shell and the cooled die cavity, or a targeted strand shell deformation.

22 Claims, 3 Drawing Sheets

Fig.1
(prior Art)
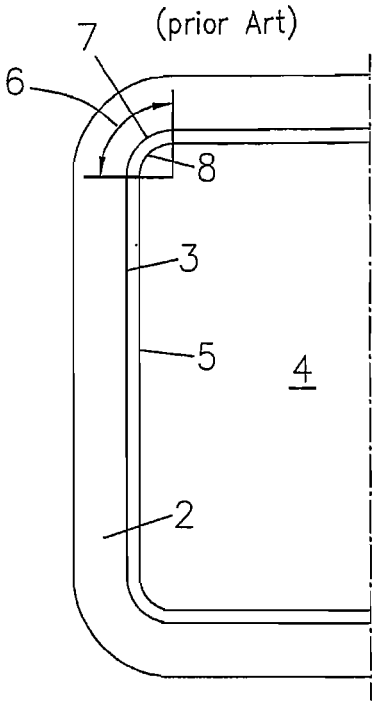
Fig.2
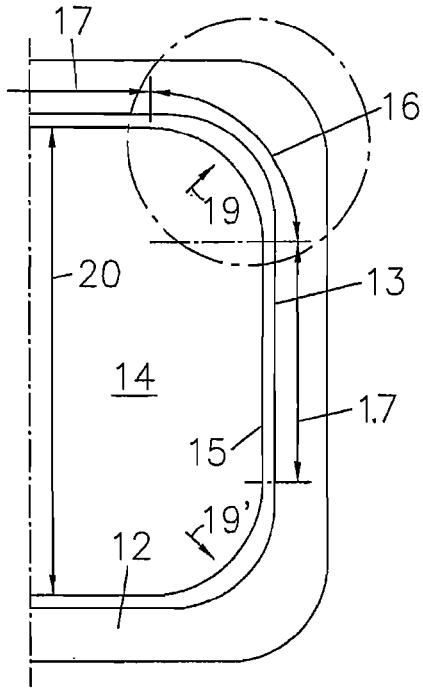
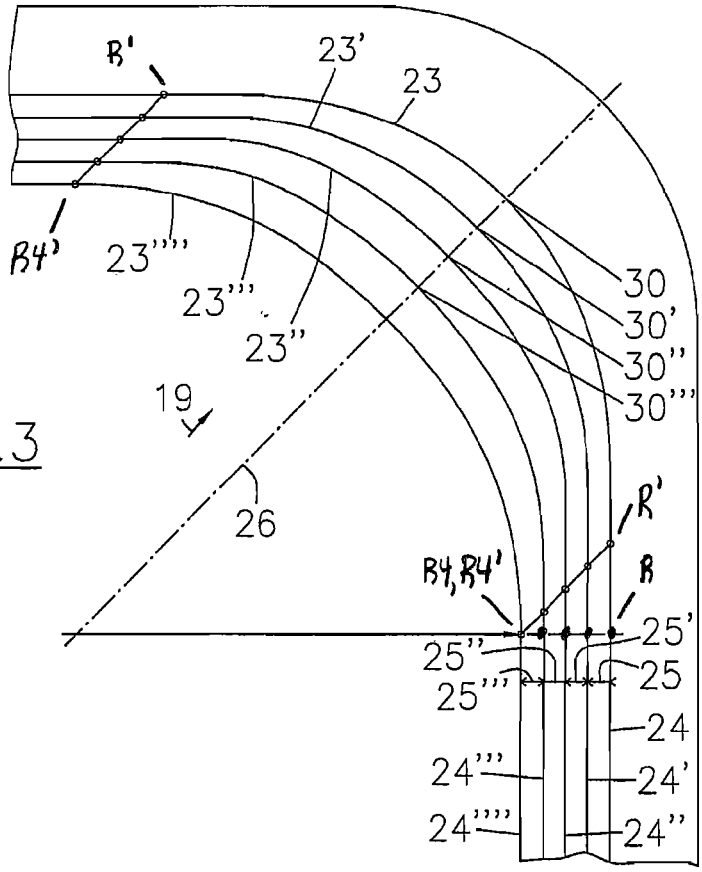
Fig.3

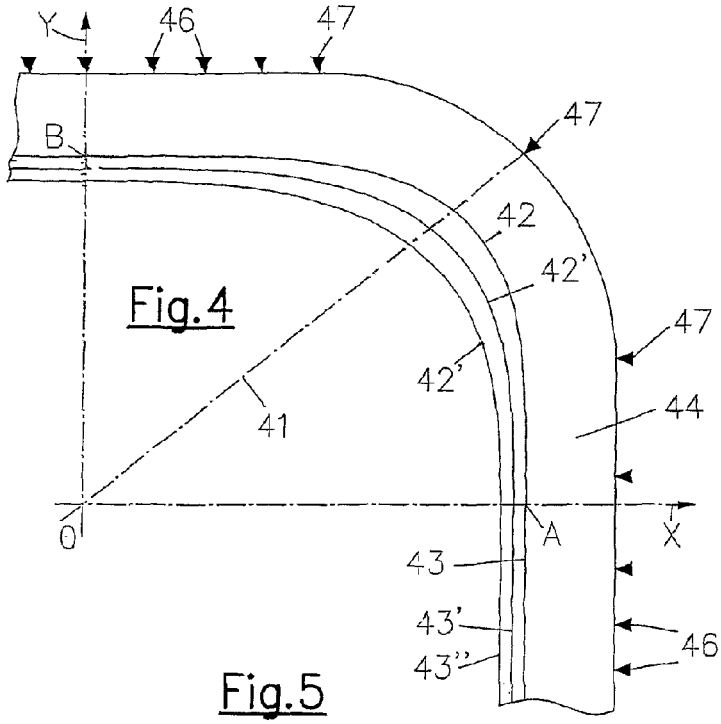
Fig.4
Fig.5
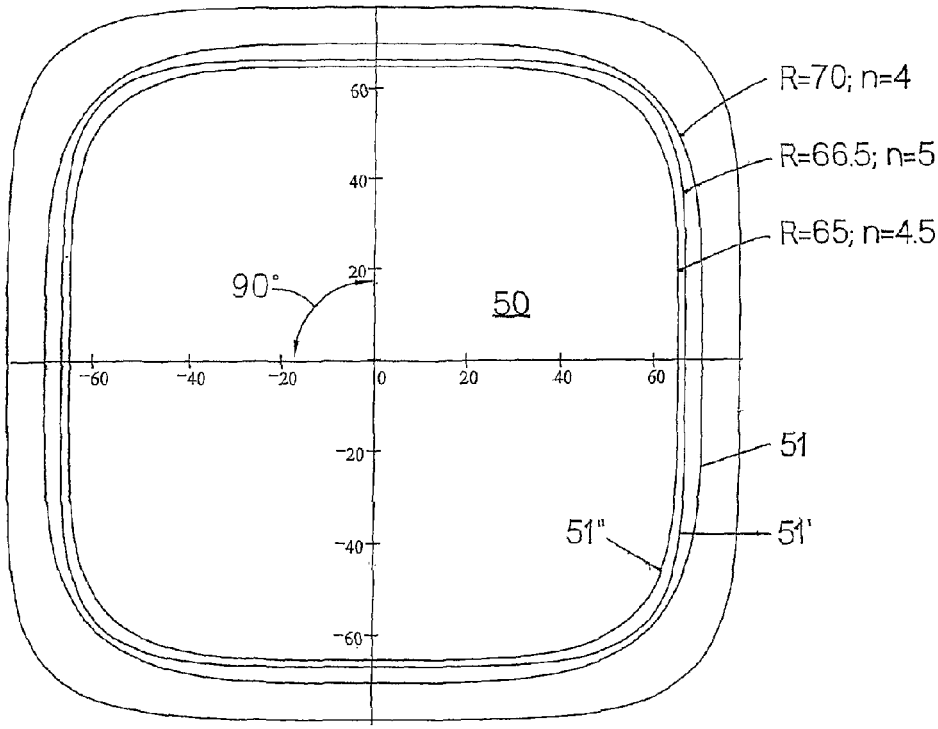

DIE CAVITY OF A CASTING DIE FOR CONTINUOUSLY CASTING BILLETS AND BLOOMS

This application claims the benefit of priority from prior PCT Application No. PCT/EP2004/014139 filed on Dec. 11, 2004, which claims the benefit of European Application No. 03029867.3 filed Dec. 27, 2003, the entirety of which are incorporated by reference herein.

BACKGROUND OF THE INVENTION

1. Field of the Invention

The invention relates to a die cavity of a continuous casting die.

2. Description of Related Art

Continuously cast long products are predominantly cast in tubular casting dies with a rectangular, in particular with an approximately square or round cross-section. The billets and blooms are then further processed by rolling or forging.

Uniform heat transfer along the peripheral line of the strand cross-section between the strand being formed and the die cavity wall is of vital significance to the production of continuously cast products, especially of billets and blooms, having good superficial and microstructural quality. Many proposals are known for configuring the die cavity geometry, in particular in the region of the concave corner surfaces of the die cavity, in such a manner that no air gaps occur between the strand shell being formed and the die wall which cause reheating of the strand shell or nonuniform heat transfer along the peripheral line of the strand cross-section.

The corners of the die cavity of tubular casting dies are rounded by concave surfaces. The larger the concave surfaces in the die cavity are made, the more difficult it is to achieve uniform cooling between a strand shell being formed and the casting die walls, in particular over the periphery of the die cavity. The onset of strand solidification just beneath the bath level in the casting die proceeds differently on the straight portions of the die cavity periphery than in the concave surface regions. Heat flow at the straight or substantially straight portions is virtually one-dimensional and obeys the law governing heat transmission through a planar wall. In contrast, heat flow in the rounded corner regions is two-dimensional and obeys the law governing heat transmission through a curved wall.

As it forms, the strand shell is in general initially thicker in the corner regions than on the straight surfaces and begins to shrink earlier and to a greater extent. This means that after only approx. 2 seconds, the strand shell draws away from the die wall in the corner regions and an air gap forms which severely impairs heat transmission. This impairment of heat transmission not only delays further shell growth, but may even result in remelting of already solidified interior layers of the strand shell. This fluctuation in the heat flow (cooling and reheating) leads to strand defects such as superficial and internal lengthwise cracks at the edges or in regions close to the edges, and to defects in shape such as rhomboid deformation, necking etc.

The larger the concave surfaces are made relative to the side length of the strand cross-section, in particular if the radii of the concave surfaces account for 10% and more of the side length of the die cavity cross-section, the greater will be the incidence and extent of the stated strand defects. This is one reason why the concave surface radii are generally limited to 5 to 8 mm, although greater levels of rounding at the strand edges would be advantageous for subsequent rolling.

JP-A-53 011124 discloses a billet casting die for continuous casting with corner radii rounded as concave surfaces. The strand may cool irregularly in such casting dies and strands may be obtained with a diamond-shaped cross-section and corresponding edge defects, such as cracks etc. In order to avoid such strand defects, said document proposes equipping a rectangular casting die cavity with 2 small and 2 large concave corner surfaces. Using these different corner radii of the concave surfaces, it is intended to effect solidification of a strand shell of irregular thickness. It is intended to compensate the delayed solidification in the corners with large radii by enhanced edge cooling in the secondary cooling zone immediately on discharge from the casting die. These measures are intended to result in an unwarped strand cross-section.

JP-A-60 040647 discloses a continuous casting die for a blank. When casting blanks, lengthwise cracks often occur at the transition from the central web to the two end flanges. In the casting die, this transitional part is a convexly rounded edge portion onto which the profile strand shrinks slightly on cooling of the central web. In order to avoid this shrinkage or the formation of cracks, said document proposes providing this convex transitional curve of the casting die with a continuously increasing curvature towards the central web.

JP-A-11 151555 discloses a further casting die for continuously casting billets and blooms. In order to avoid rhombic distortion of the strand cross-section in this casting die too and additionally to increase casting speed, the casting die is provided with specially shaped corner cooling parts at the four corners which are provided with concave surfaces. At the pouring end, these corner cooling parts are circular recesses in the die wall which diminish in the direction of strand travel and, towards the die outlet, reduce to the rounding of the concave corner surface. The degree of curvature of the circular recess increases in the direction of strand travel towards the die outlet. This shape is intended to ensure uninterrupted contact between the corner region of the strand shell and the corner parts of the casting die.

SUMMARY OF THE INVENTION

The object of the invention is to provide a die cavity geometry for a continuous casting die which ensures optimum conditions for uniform heat exchange between the strand shell being formed and the die wall along the peripheral line of the strand cross-section and consequently a symmetrical temperature field in the strand shell. Cooling and the die cavity geometry should in particular be optimized along the periphery of the die cavity with curved wall portions and the transition from curved to substantially straight wall portions. In this way, it is intended to achieve an improved, uniform solidification profile of a strand shell being formed on passage through the casting die, in order to avoid stresses in the strand shell, the formation of air gaps between the strand shell and the die wall, necking, diamond shape of the strand cross-section and cracks in the strand shell, etc. Such a die cavity should furthermore enable higher casting speeds relative to the prior art and be economic to produce.

Thanks to the process according to the invention and the geometry of the casting die cavity according to the invention, it is possible to create optimum conditions for uniform heat exchange along the peripheral line of the strand cross-section between a strand shell being formed and the die cavity wall. The optimized, uniform heat exchange ensures that the strand shell being formed in the casting die solidifies with a crystal microstructure which is uniform over the periphery without defects such as cracks, stress concentrations, diamond shape, etc. It is further possible to define such die cavities by mathematical curve functions and to produce them economically on NC machine tools.

If the conicity of the die cavity for a specific grade of steel and a specific residence time of a strand being formed within the casting die cavity is established, uniform shell growth or uniform nominal heat transmission along the peripheral line can be verified by casting tests. According to an advantageous embodiment, any remaining variations in the nominal heat transmission between the strand shell being formed and the die cavity wall can be compensated by cooling those die cavity walls with a greater degree of curvature more gently, or those with a smaller degree of curvature more strongly.

In a conventional casting die, straight lines of the die cavity periphery intersect tangentially with a circular arc line of the corner rounding at the "tangent point". Such punctual transitions and circular roundings are advantageously to be replaced by arc lines with the shape of a curve function with one or two basic parameters and with one exponent, for example a superellipse. Furthermore, the curvature of successive arc lines in the direction of strand travel may be varied continuously or discontinuously by appropriate selection of the basic parameters and exponents of the mathematical curve function. Arc line shapes and thus the geometry of the cavity may be adapted to particular casting parameters by reducing or increasing the exponent.

If physical contact between the strand shell being formed and the cooled die wall on passage through the casting die is not interrupted by uncontrolled air gap formation, the heat flow will obey physical laws governing heat flow. This idealized state assumes that the geometry of the casting die cavity is established in accordance with the physical laws governing heat flow on the one hand and the shrinkage of the strand shell on the other hand and that the die cavity geometry is established in accordance with mathematically defined curve functions. According to an exemplary embodiment, an optimum mathematically defined die cavity geometry is obtained if the arc lines of the peripheral line of the die cavity are selected in accordance with the curve function of a superellipse $$\left|\frac{X}{A}\right|^n + \left|\frac{Y}{B}\right|^n = 1$$

where

X is the x-coordinate value of the curvature profile;

Y is the y-coordinate value of the curvature profile;

A is the radii or semi-axis (width) of the curvature profile of the corner region in the x-direction; and B is the radii or semi-axis (width) of the curvature profile of the corner region in the y-direction.

and successive arc lines in the direction of strand travel are varied in their curvature or degree of curvature by selection of the exponent "n" and the basic parameters A and B (ellipse semiaxes).

In order to achieve substantially uniform nominal heat transmission along the peripheral line, it is additionally possible to subject the strand shell within the casting die to slight plastic deformation, i.e. to compel it to conform to the geometry of the cavity. According to another exemplary embodiment, it is proposed to compose the peripheral line of four arc lines, which each enclose an angle of 90°. Successive arc lines in the direction of strand travel are dimensioned such that a convex strand shell is deformed on passage through the casting die cavity at the pouring end of the casting die, at least over a first part of the length of the casting die such that, at least in central regions between the corner regions, the convexity of the strand shell is reduced or, in other words, the arc lines extend into the central regions of the periphery of the strand, or the degree of curvature 1/R is reduced.

If, for example, a concavely curved corner region is to be provided between four substantially planar side walls in a die cavity cross-section which is similar to rectangular in shape or preferably similar to square in shape, according to one exemplary embodiment the degree of curvature of successive concave surface arcs in the direction of strand travel may be selected in accordance with the curve function $|X|^n+|Y^n=|R|^n$ where "R" is the radius and the exponent "n" varied between 2.01 and 10.

If a die cavity cross-section similar to rectangular in shape is to consist substantially of four arc lines, which each enclose ¼ of the peripheral line, according to a further exemplary embodiment the curve function $$\left|\frac{X}{A}\right|^n + \left|\frac{Y}{B}\right|^n = 1$$

is selected and the exponent "n" of successive peripheral lines in the direction of strand travel is varied between 2 and about 100, preferably 4 and 50.

In the case of a die cavity cross-section similar to square or round in shape, combined with slight plastic deformation of the strand shell, in accordance with the Convex Technology described in patent EP 0 498 296, the value of the exponent "n" of successive peripheral lines in the direction of strand travel may, according to a further exemplary embodiment, be between 4-50 for rectangular formats and between 2 and 2.5 for round formats.

Apart from mathematically defined curved peripheral lines of the casting die cavity cross-section, dimensioning of the water cooling of the copper wall may also be taken into account in order to achieve substantially uniform nominal heat transmission. It is proposed according to an additional exemplary embodiment that, as the degree of curvature of the curved peripheral line of the die cavity increases, in particular in the corner regions with concave surface arcs, water cooling of the copper wall is reduced.

In general, casting dies for continuously casting steel in billet and blank formats are made from relatively thin-walled copper tubes. Machining of such tubular casting dies can only proceed through the pouring orifice or strand discharge orifice. Apart from tubular casting dies with a straight longitudinal axis, in "curved" continuous casters tubular casting dies with a curved longitudinal axis are also used, which further complicate machining of the casting die cavity. In order to achieve elevated dimensional accuracy, it is proposed according to a further exemplary embodiment to produce the die cavity of the casting die by means of a numerically controlled cutting machine tool.

BRIEF DESCRIPTION OF THE DRAWINGS

The foregoing and other features of the present invention will be more readily apparent from the following detailed description and drawings of illustrative embodiments of the invention where like reference numbers refer to similar elements throughout and in which:

FIG. 1 shows a plan view of a left hand half of a casting die tube according to the prior art for a billet cross-section;

FIG. 2 shows a plan view of a right hand half of a casting die tube for a billet cross-section according to embodiments of the invention;

FIG. 3 shows an enlarged corner detail of the casting die tube according to FIG. 2;

FIG. 4 shows an enlarged corner detail of a casting die tube with a rectangular cross-section with unequal side length according to embodiments of the invention;

FIG. 5 shows peripheral lines of a square die cavity cross-section according to embodiments of the invention;

DESCRIPTION OF EMBODIMENTS OF THE INVENTION

Figure 6:
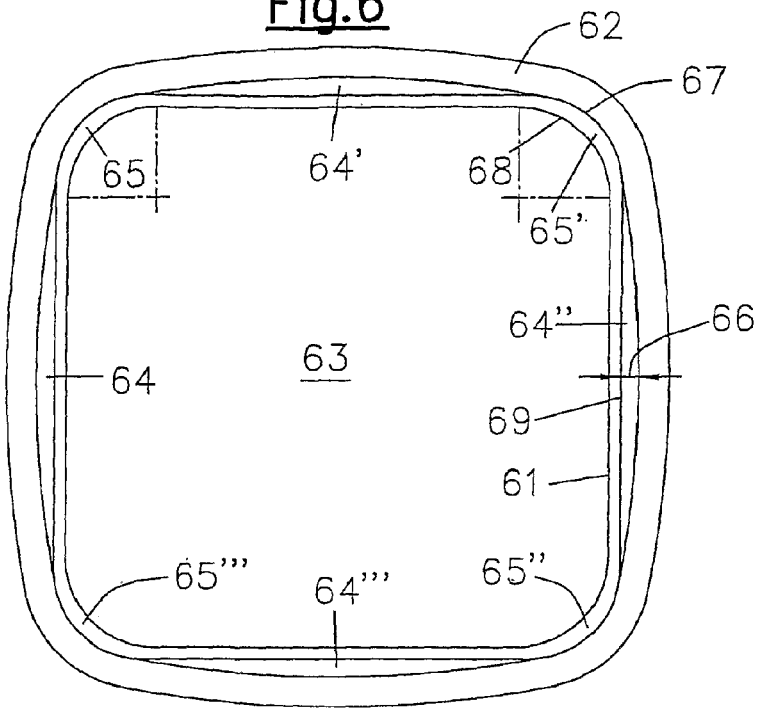
FIG. 6 shows a casting die with strand shell deformation (Convex Technology) according to embodiments of the invention.

FIG. 1 shows one half of a casting die tube 2 made from copper. A peripheral line 3 of a die cavity 4 represents the casting die orifice at the pouring end and a peripheral line 5 represents the casting die orifice at the strand discharge end. The peripheral line 5 is smaller than the peripheral line 3 by a conicity of the die cavity 4. A portion 6 of the peripheral lines 3 and 5 of the die cavity cross-section comprises a circular arc line in the form of a concave corner surface with a corner radius of for example 6 mm. The walls of the casting die tube 2, also denoted die cavity walls, are water-cooled, as is widely known from the prior art. The degree of curvature 1/R of a circular arc line 7 in the portion 6 at the pouring end is less than the degree of curvature 1/R of a circular arc line 8 in the portion 6 at the strand outlet end.

FIG. 2 shows one half of a casting die tube 12 with peripheral lines 13 and 15 of a die cavity 14. The peripheral line 13 of the casting die cavity cross-section delimits the die cavity 14 at the pouring end and the peripheral line 15 delimits the die cavity 14 at the strand discharge end. The peripheral lines 13, 15, or the die cavity wall, are curved in the corner regions along portions 16 and are straight along portions 17. Concave surface arcs in the corner regions 19, 19' are dimensioned such that they occupy on both sides at least 10% of the side length 20 of the die cavity cross-section at the die outlet. At a cross-section of for example 120 mm×120 mm, the concave surface arc occupies on each side at least 12 mm of the side length 20, preferably 18-24 mm or 15-20% the side length 20. The curved peripheral line 13 in the corner regions 19 is defined by a mathematical curve function with a basic parameter and an exponent which differs from a circular line. FIG. 3 exhaustively illustrates the shaping of the corner region 19.

In the corner region 19, FIG. 3 shows successive arc lines 23-23"" in the direction of strand travel. The corner region 19 may be of constant width from the pouring end to the discharge end along the casting cone, and the curved to straight transition points may be arranged on the transition point line R-R4 or alternatively on a straight or curved transition point line (die cavity shown in FIG. 6) R'-R4', with corner regions of increasing width from the pouring end to the discharge end. Distances 25-25''' exhibit a constant conicity of the die cavity. The arc lines 23-23"" and the straight line 24-24"" amount to contour lines of the die cavity wall. The arc lines are defined by the mathematical curve function $|X|^n+|Y|^n=|R|^n$, the degree of curvature of each arc line 23-23"" being established by selection of the exponent "n". One object of the selection is to configure the die cavity in such a manner that the strand shell being formed cools uniformly over the casting die periphery and a maximally symmetrical temperature field is established in the strand shell. Depending on the shape of the strand cross-section, nominal heat transmission which is substantially uniform over the periphery may be achieved in cross-sections which are similar to round in shape solely by the geometry of the die cavity cross-section or, in the case of die cavity cross-sections which are similar to rectangular in shape, with a combination of geometry and different cooling along the peripheral line. In the present Example, the exponent of the curve function is varied as follows:

arc line 23 exponent "n" 4.0
arc line 23' exponent "n" 3.5
arc line 23" exponent "n" 3.0
arc line 23''' exponent "n" 2.5
arc line 23"" exponent "n" 2.0 (circular arc)

In this Example, the exponent varies continuously between 4 and 2. Depending on the selected conicity of the die cavity, discontinuous changes may also be used. Due to the reduction of the exponent between 4 and 2, the degree of curvature of the arc lines becomes smaller, or in other words, the arc lines extend towards the die outlet. This extension further ensures that die cavity conicity is greatest along a diagonal 26 and decreases towards the straight walls. The degree of curvature of the curved peripheral lines 23-23''' grows towards the maximum degree of curvature 30-30'''. The degree of curvature along the curved peripheral line 23"" is constant (circular arc). In the curved portion 16 of the corner regions 19, elimination of the gap between the strand shell moving through the die cavity and the die cavity wall or deformation of the strand shell may be purposefully controlled.

FIG. 4 shows a corner detail which is asymmetrical on each side of a diagonal 41. The dimension OB is not equal to OA. The curve function of arc lines 42-42" is $$\left|\frac{X}{A}\right|^n+\left|\frac{Y}{B}\right|^n=1$$

In this Example, the arc lines 42-42" have the following exponents:

arc line 42 exponent "n"=4.0
arc line 42' exponent "n"=3.4
arc line 42" exponent "n"=3.0

The arc lines 42-42" are followed by straight peripheral portions 43-43".

A die cavity wall 44 consists of copper. A different intensity of cooling is represented schematically by triangles 46, 47 each unequally spaced apart on the outside of the casting die. The more closely arranged triangles 46 indicate greater intensity of cooling and the more widely spaced apart triangles 47 indicate a lower intensity of cooling.

For clarity's sake, the Example in FIG. 5 shows only three successive peripheral lines 51-51" in the direction of strand travel of a die cavity 50 which is similar to square in shape. Each peripheral line is composed of four arc lines, each of which encloses an angle of 90°. The four arc lines obey the mathematical function $$|X|^n+|Y|^n=|R|^n.$$

If casting conicity "t" is likewise represented in the mathematical function, it reads for example $$|X|^n+|Y|^n=|R-t|^n.$$

This Example is based on the following numerical values:

| Arc line | Exponent n | R − t | t |
|---|---|---|---|
| 51 | 4 | 70 | 0 |
| 51' | 5 | 66.5 | 3.5 |
| 51" | 4.5 | 65 | 5 |

Depending on the selected size and interval between successive exponents in the direction of strand travel, the peripheral line may be configured such that, at least along part of the length of the casting die, deformation of the strand shell is achieved between the concavely curved corner regions on passage through the casting die by appropriate selection of the exponent of successive arc lines.

In the Example shown in FIG. 5, the exponent "n" of the two successive arcs 51 and 51' in the direction of strand travel is increased, for example, from 4 to 5 in order to achieve strand shell deformation, in particular between the corner regions (Convex Technology) at the pouring end half of the casting die. In the strand discharge end half of the casting die, uniform nominal heat transmission substantially without strand shell deformation is achieved between the successive arc lines 51' and 51" in the direction of strand travel by a reduction in the exponent from for example 5 to 4.5. This Example shows that it is possible to achieve nominal heat transmission in successive arc lines in the direction of strand travel in a first part of the casting die by increasing the exponent and in a second part of the casting die by reducing the exponent, i.e. by adapting the geometry of the die cavity. On the other hand, it is however also possible to achieve nominal heat transmission with or without strand shell deformation by cooling along the peripheral line which differs as a function of the geometry of the curved peripheral line.

FIG. 6 shows a tubular casting die 62 of copper for continuously casting billets or blooms of steel with a die cavity 63. The cross-section of the die cavity 63 is square at the die outlet and concavely curved corner regions 65-65''' are arranged between adjacent side walls 64-64'''. The concave surface arcs do not take the form of a circular line, but instead exhibit a curve shape in accordance with the mathematical function $|X|^n+|Y|^n=|R|^n$, the exponent "n" exhibiting a value of between 2.0 and 2.5. In this Example, the curve shape of the concave surface arc 67 at the casting die pouring end is defined with an exponent n=2.2 and the curve shape of the concave surface arc 68 at the casting die discharge end is defined with a exponent n=2.02, i.e. the curve shape is very close to a circular arc at the strand discharge end. If the convex bulge is cosine governed, the curve shape of the concave surface arc may be defined with an exponent "n" of between 3 and 10.

In the exemplary embodiment in FIG. 6, the side walls 64-64''' of the die cavity 63 in the upper part of the casting die are shaped convexly over part of the length of the casting die 62, for example 40%-60% of the length of the casting die. Over this part of the length, the arc height 66 of the convexity declines in the direction of strand travel. A strand which is being formed in the casting die is continuously slightly deformed over the part of the length exhibiting convexity, until the arc becomes a straight line. In the second lower half of the casting die, the peripheral lines 61, 69 of the die cavity 63 are straight. In this part of the casting die, the die cavity is provided with conicity which corresponds to the shrinkage of the strand cross-section in this part of the casting die.

In casting dies with convex side walls, the exponent "n" is selected in such a manner that the chord elongation with decreasing arc height does not exert any harmful pressure on the solidifying strand shell in the corner regions 65-65''' and the heat flow in the rounded corner regions 65-65''' is adjusted to the heat transmission of the substantially straight walls. Additional adjustment of heat transmission may be achieved by different cooling of the die cavity walls along the peripheral line of the casting die cavity cross-section.

Figure 7:
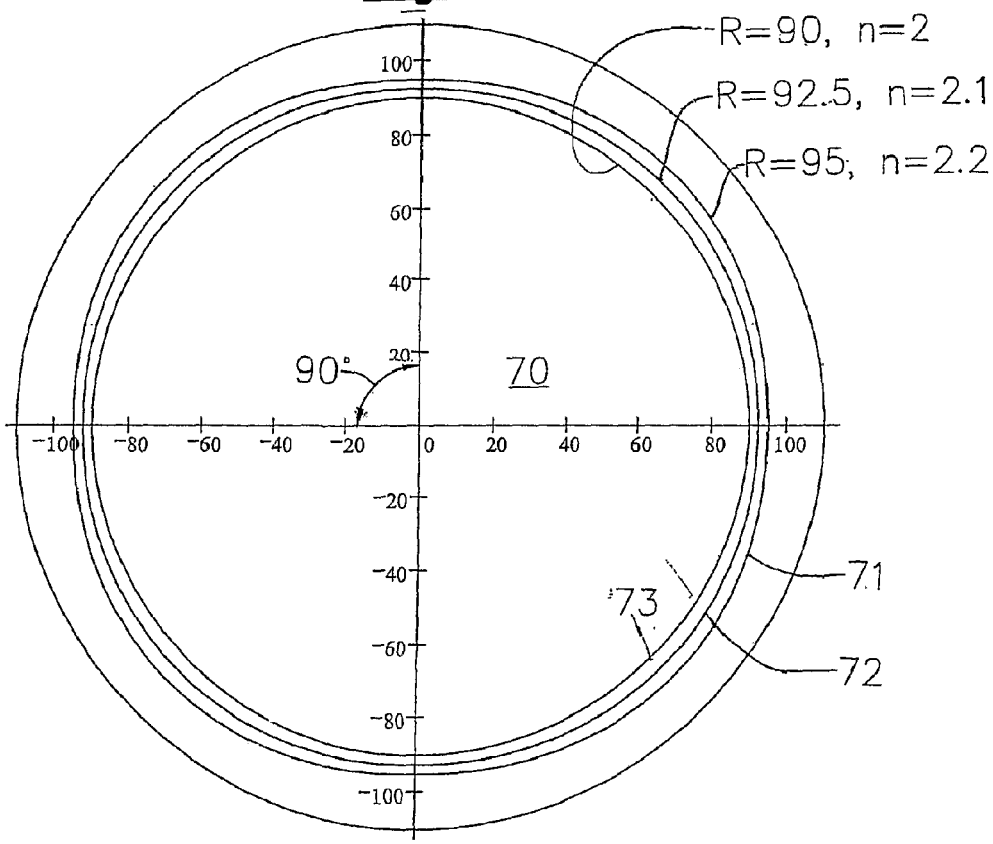
FIG. 7 shows peripheral lines for a substantially round cross-section according to embodiments of the invention.

FIG. 7 is a schematic representation of three peripheral lines 71-73 for a die cavity 70 which is round at the casting die outlet end. The peripheral lines 71 and 72 are composed of four arc lines which in this example enclose an angle of 90°. These arc lines obey the mathematical curve function $|X|^n+|Y|^n=|R^n$ and the value of the exponent "n" of the arc lines 71 and 72 is 2.2 and 2.1 respectively. The peripheral line 73 at the die outlet is circular. In an upper part of the length of the casting die with a die cavity cross-section similar to circular in shape, a measure of plastic deformation of the strand shell being formed in the upper half of the casting die may be determined by an increase in the difference in the curve function exponent between the arc lines 71 and 72. The measure of plastic deformation codetermines the heat transmission between the strand shell and die wall.

For simplicity's sake, all the die cavities in FIGS. 1-7 are provided with a straight longitudinal axis. Casting dies for circular arc continuous casters exhibit a curved longitudinal axis with a radius which is generally between 4 m and 12 m.

Those skilled in the art will recognize that the materials and methods of the present invention will have various other uses in addition to the above described embodiments. They will appreciate that the foregoing specification and accompanying drawings are set forth by way of illustration and not limitation of the invention. It will further be appreciated that various modifications and changes may be made therein without departing from the spirit and scope of the present invention, which is to be limited solely by the scope of the appended claims.

What is claimed is:

1. A casting die comprising a die cavity having a length through which a strand travels, wherein peripheral lines of the die cavity each include a curved portion in at least one corner region thereof, and each curved portion has a curvature profile that grows towards and then away from a maximum degree of curvature (1/R), wherein the maximum degree of curvature of successive peripheral lines in the corner region in a direction of strand travel is reduced over at least part of the length of the die cavity.

2. Casting die according to claim 1, wherein the reduction of the maximum degree of curvature is continuous.

3. Casting die according to claim 1, wherein the reduction of the maximum degree of curvature is discontinuous.

4. Casting die according to claim 1, wherein the peripheral lines have a curved portion in all corner regions.

5. Casting die according to claim 1, wherein the curvature profile is $$\left|\frac{X}{A}\right|^n+\left|\frac{Y}{B}\right|^n=1$$

wherein

X is the x-coordinate value of the curvature profile;

Y is the y-coordinate value of the curvature profile;

A is the semi-axis of the curvature profile of the corner region in the x-direction;

B is the semi-axis of the curvature profile of the corner region in the y-direction; and "n" is greater than 2 and less than about 100.

6. Casting die according to claim 5, wherein A =B the curvature profile is $|X|^n+|Y|^n=|R|^n$, wherein R is the radius.

7. Casting die according to claim 1, wherein the die cavity has a substantially rectangular cross-section and comprises curved portions in concavely curved corner regions located between four substantially planar side walls, wherein the curvature profile of each curved portion is $|X|^n+|Y|^n=|R|^n$ wherein X is the x-coordinate value of the curvature profile;

Y is the y-coordinate value of the curvature profile;

R is the radius; and

"n" is greater than 2 and no more than about 10.

8. Casting die according to claim 7, wherein the die cavity has a substantially square cross-section.

9. Casting die according to claim 1, wherein the die cavity has a substantially rectangular cross-section and is comprised of four curved portions that each enclose an angle of approximately 90° and have a curvature profile of $$\left|\frac{X}{A}\right|^n+\left|\frac{Y}{B}\right|^n=1,$$

wherein

X is the x-coordinate value of the curvature profile;

Y is the y-coordinate value of the curvature profile;

A is the semi-axis of the curvature profile of the corner region in the x-direction;

B is the semi-axis of the curvature profile of the corner region in the y-direction; and "n" is between about 3 and about 50.

10. Casting die according to claim 9, wherein "n" is between about 4 and about 10.

11. Casting die according to claim 1, wherein the die cavity has a substantially circular cross-section and is comprised of four curved portions that each enclose an angle of between about 15° and about 180° and have a curvature profile of $|X|^n+|Y|^n=|R|^n$, wherein X is the x-coordinate value of the curvature profile;

Y is the v-coordinate value of the curvature profile;

R is the radius; and

"n" is greater than 2 and less than about 2.3.

12. Casting die according to claim 1, wherein the die cavity has a substantially square cross-section and is comprised of four curved portions that each enclose an angle of about 90° and have a curvature profile of $|X|^n+|Y|^n=|R|^n$, wherein X is the x-coordinate value of the curvature profile;

Y is the v-coordinate value of the curvature profile;

R is the radius;

and wherein over at least part of the length of the casting die, the curved portions extend into a portion of the peripheral lines between concavely curved corner regions.

13. Casting die according to claim 1, wherein the curved portions extend so as to control deformation of the strand shell as it travels through the casting die.

14. Casting die according to claim 1, wherein the die cavity has a casting conicity.

15. Casting die according to claim 14, wherein the casting conicity is "t" and the curvature profile is $|X|^n+|Y|^n=|R-t|^n$ wherein X is the x-coordinate value of the curvature profile;

Y is the y-coordinate value of the curvature profile; and

R is the radius.

16. Casting die according to claim 1, wherein the die cavity has a substantially rectangular cross-section and is comprised of concavely curved corner regions, each with a concave curved portion having a curvature profile of $|X|^n+|Y|^n=|R|^n$ wherein X is the x-coordinate value of the curvature profile;

Y is the y-coordinate value of the curvature profile;

R is the radius; and wherein "n" of successive peripheral lines is between about 2.1 and about 10, and further comprises curved side walls between the concave curved portions over at least part of the length of the casting die that plastically deform the strand as it travels therethrough.

17. Casting die according to claim 1, wherein the die cavity has a substantially square cross-section.

18. Casting die according to claim 1, wherein the die cavity is a tubular casting die.

19. Casting die according to claim 1, wherein the casting die is configured for continuously casting one of billets, blooms and blanks.

20. Casting die according to claim 1, wherein walls of the die cavity are cooled.

21. Casting die according to claim 1, wherein the casting die is comprised of water-cooled copper walls and cooling is reduced where degree of curvature increases.

22. Casting die according to claim 1, wherein geometry of the die cavity is produced by a numerically controlled, cutting machine tool.

* * * * *